US012808638B2

(12) United States Patent
Lee

(10) Patent No.: US 12,808,638 B2
(45) **Date of Patent: *Nov. 24, 2026**

(54) LIGHT-EMITTING NOCK FOR ARROWS

(71) Applicant: GT WORKS CO., LTD., Suwon-si (KR)

(72) Inventor: Gee Tae Lee, Suwon-si (KR)

(73) Assignee: GT WORKS CO., LTD., Suwon-si (KR)

( * ) Notice: Subject to any disclaimer, the term of this patent is extended or adjusted under 35 U.S.C. 154(b) by 208 days.

This patent is subject to a terminal disclaimer.

(21) Appl. No.: 18/805,611

(22) Filed: Aug. 15, 2024

(65) Prior Publication Data

US 2024/0401920 A1 Dec. 5, 2024

Related U.S. Application Data

(63) Continuation-in-part of application No. 18/174,632, filed on Feb. 26, 2023, now Pat. No. 12,092,442.

(51) Int. Cl.
*F42B 6/06* (2006.01)

(52) U.S. Cl.
CPC ..... *F42B 6/06* (2013.01)

(58) Field of Classification Search
CPC ..... F42B 6/06; F42B 12/382
USPC ..... 473/570, 578
See application file for complete search history.

(56) References Cited

U.S. PATENT DOCUMENTS

| | | | | |
|---|---|---|---|---|
| 4,340,930 | A * | 7/1982 | Carissimi | F42B 12/362 D22/115 |
| 5,134,552 | A * | 7/1992 | Call | F21V 33/008 362/276 |
| 6,123,631 | A * | 9/2000 | Ginder | F42B 12/362 473/578 |
| 7,837,580 | B2 * | 11/2010 | Huang | F42B 6/06 473/578 |
| 8,342,990 | B1 * | 1/2013 | Price | F42B 12/362 473/570 |
| 8,758,177 | B2 * | 6/2014 | Minica | F42B 6/06 473/570 |
| 9,702,672 | B1 * | 7/2017 | Kim | F42B 6/06 |
| 10,001,353 | B1 * | 6/2018 | Godsey | F42B 6/06 |
| 10,094,642 | B1 * | 10/2018 | Godsey | F42B 6/06 |
| 10,254,095 | B1 * | 4/2019 | Wang | F21V 23/04 |
| 10,704,873 | B1 * | 7/2020 | Minica | F42B 6/06 |
| 10,794,672 | B2 * | 10/2020 | Oman | F21V 23/0414 |
| 10,859,353 | B1 * | 12/2020 | Minica | F42B 6/06 |
| 2023/0417521 | A1 * | 12/2023 | Voigt | F21V 33/008 |

* cited by examiner

*Primary Examiner* — Alexander R Niconovich
(74) *Attorney, Agent, or Firm* — You & IP, LLC

(57) ABSTRACT

Disclosed is a lighted nock for an arrow, and more particularly, to a lighted nock for an arrow that is configured to simply and easily turn off a luminous lamp without using a separate mechanism when an internal luminous lamp of the lighted nock is turned on by shooting the arrow and then turning off the luminous lamp again.

1 Claim, 9 Drawing Sheets

LIGHT-EMITTING NOCK FOR ARROWS

CROSS REFERENCE TO RELATED APPLICATION

This application is a continuation-in-part application of co-pending U.S. application Ser. No. 18/174,632, filed Feb. 26, 2023, the disclosure of which is incorporated herein by reference.

TECHNICAL FIELD

The present invention relates to a lighted nock for an arrow, and more particularly, to a lighted nock for an arrow that is configured to simply and easily turn off a luminous lamp without using a separate mechanism when an internal luminous lamp of the lighted nock is turned on by shooting the arrow and then turning off the luminous lamp again.

BACKGROUND

In general, an arrow 1 used for archery includes, as illustrated in FIG. 1, an arrow shaft 10 having a cylindrical cross section made of duralumin, glass fiber, carbon fiber, or the like to form a body, an arrow head 20 fitted to the front end of the arrow shaft 10, feathers 30 designed to keep the direction of a trajectory upon flight of the arrow 1, and a nock 40 serving to fit a string (bow string) thereon.

In addition, there has been recently developed a technology of providing the arrow with a light emitting function in order to enable a user to effectively enjoy games of archery even at night or on a cloudy day. In this case, a luminous lamp and a battery are provided to the rear end of the arrow, that is, on the nock 40, and the luminous lamp is turned on/off, so that it is possible to use the arrow with the light emitting function.

However, in the conventional arrow with the light-emitting function, the luminous lamp is turned on when an arrow is shot and the luminous lamp is kept turned on until artificially turned off, and thus the battery is consumed.

Accordingly, in the case of turning off the luminous lamp again, there are inconvenient problems that a structure of the nock 40 for turning off the luminous lamp is complicated and an operation of practically turning off the luminous lamp should be performed by using a fine tool such as a small-sized driver.

SUMMARY

According to an embodiment of the present invention, a lighted nock for an arrow according to the present invention includes an upper body housing; a lower body housing; a turning off switch housing mounted between the upper body housing and the lower body housing and moving in a forward direction due to the tension of a string when the arrow is shot; a luminous lamp assembly mounted between the upper body housing and the lower body housing, configured by being inserted into the turning off switch housing, and moved with the turning off switch housing in the same direction when the turning off switch housing is moved; a battery assembly mounted between the upper body housing and the lower body housing, including an internal battery in contact with the luminous lamp assembly when the luminous assembly is moved, and supplying power so that a luminous lamp mounted on the luminous lamp assembly is turned on; a turning off switch housing mounted between the upper body housing and the lower body housing, configured to be in contact with the luminous lamp assembly, and moved with the luminous lamp assembly in the same direction when the luminous lamp assembly is moved; and push buttons configured respectively in the upper body housing and lower body housing, configured to be in contact with the turning off switch housing when the turning off switch housing is moved in the forward direction, and configured to turn off the luminous lamp by moving the luminous lamp assembly in contact with the turning off switch housing in the backward direction and blocking the contact between the luminous lamp assembly and the internal battery of the battery assembly when the button is pressed.

DETAILED DESCRIPTION

Hereinafter, an explanation on a lighted nock for an arrow according to the present invention will be in detail given with reference to attached drawings.

Figure 1:
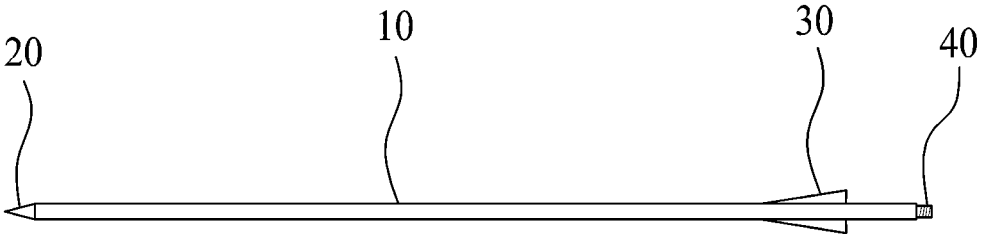
FIG. 1 is a view of a conventional arrow structure.
Figure 2:
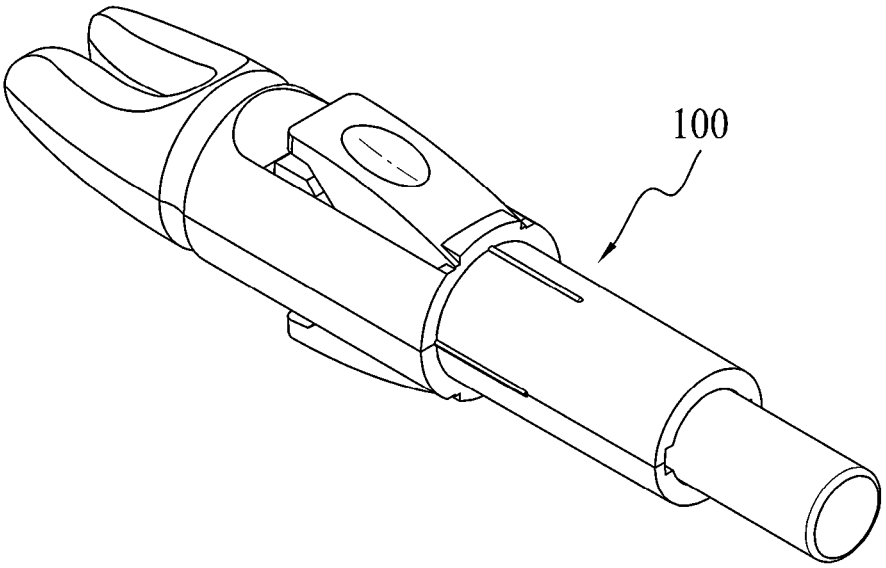
FIG. 2 is a perspective view of a lighted nock for an arrow according to the present invention.

As shown in FIG. 2, the present invention relates to a lighted nock 100 for an arrow mounted at a rear end of an arrow, a front portion of a cylindrical structure is fitted to the rear end of the arrow, and a string (or bow string) is placed in a concave groove of a rear portion.

The lighted nock 100 for an arrow of the present invention may be applied to various bows such as a recurve bow, a long bow, a compound bow, and the like.

Figure 3:
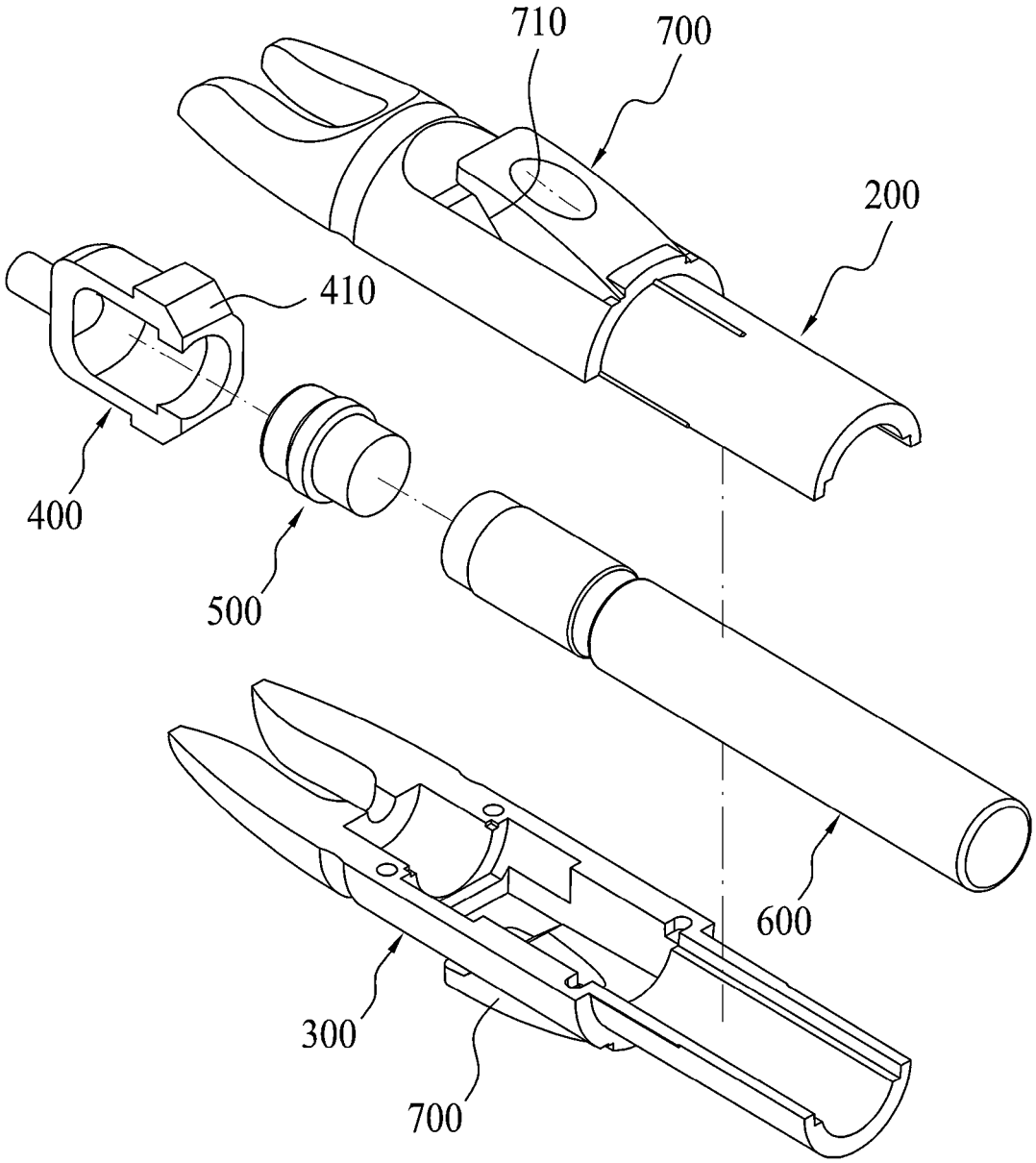
FIG. 3 is an exploded perspective view of a lighted nock for an arrow according to the present invention.
Figure 4:
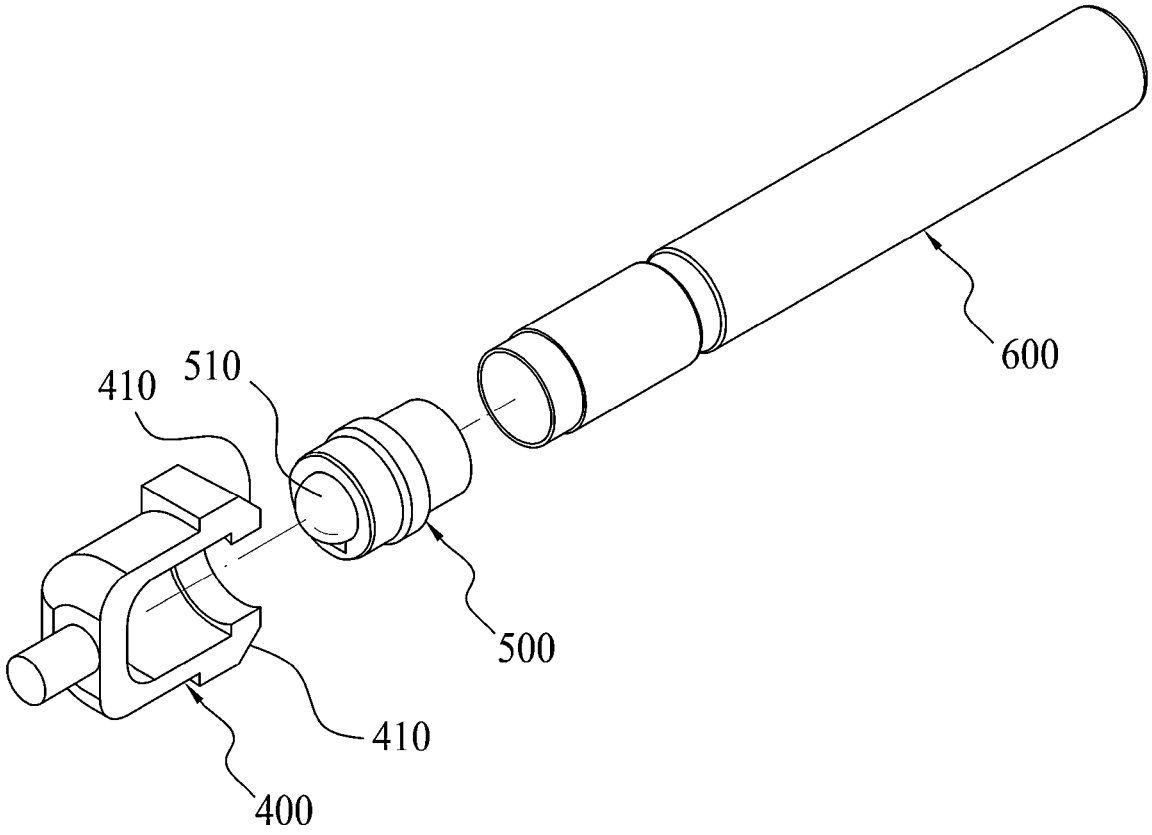
FIG. 4 is an enlarged view of internal components of the lighted nock for an arrow according to the present invention.
Figure 5:
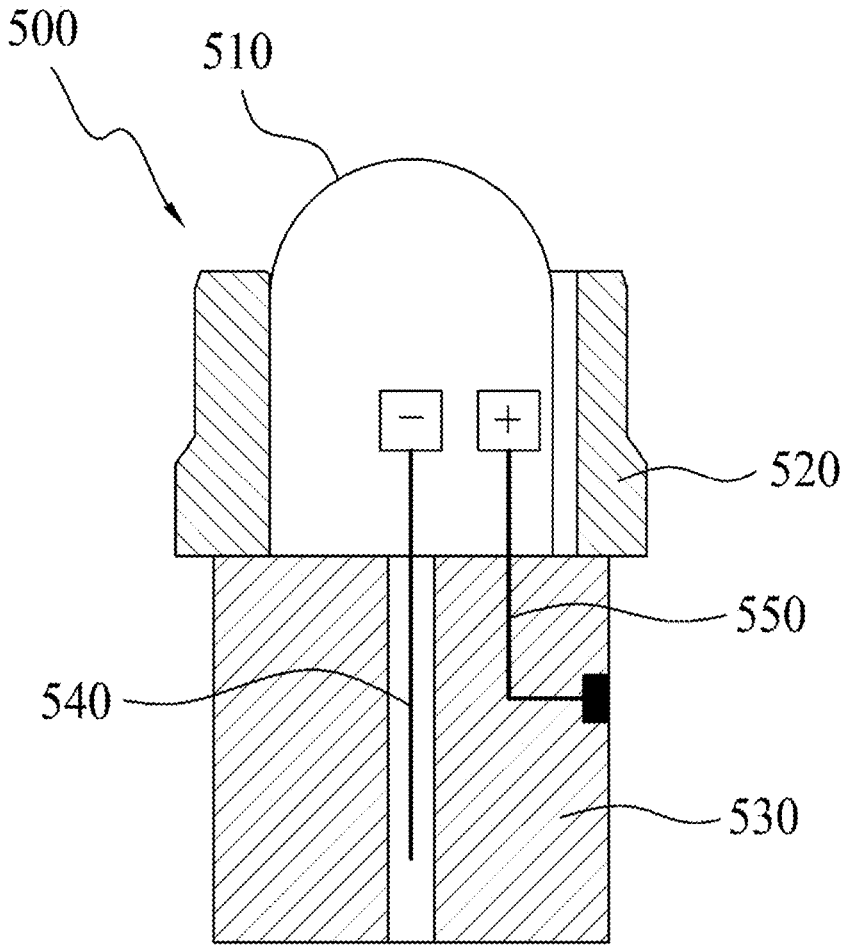
FIG. 5 is an internal configuration diagram of a luminous lamp assembly according to the present invention.

FIG. 3 is an exploded perspective view of a lighted nock for an arrow according to the present invention. FIG. 4 is an enlarged view of internal components of the lighted nock for an arrow according to the present invention. FIG. 5 is an internal configuration diagram of a luminous lamp assembly according to the present invention.

Referring to FIGS. 3 and 4, the lighted nock 100 for an arrow according to the present embodiment includes an upper body housing 200, a lower body housing 300, a turning off switch housing 400, a luminous lamp assembly 500, a battery assembly 600, and a push button 700.

The luminous lamp assembly 500 and the battery assembly 600 may be integrally coupled and used as one component.

The interior of the upper body housing 200 and the lower body housing 300 is designed to have a structure in which each component is mounted and operated.

The turning off switch housing 400 is movably mounted between the upper body housing 200 and the lower body housing 300, and the turning off switch housing 400 linearly moves in a forward direction due to the tension of the string when the arrow is shot.

Similarly, the luminous lamp assembly 500 is movably mounted between the upper body housing 200 and the lower body housing 300.

In more detail, the luminous lamp assembly 500 is configured by being inserted into the turning off switch housing 400 and to be linearly moved in the same direction when the turning off switch housing 400 moves linearly in the forward direction thereof.

The luminous lamp assembly 500 includes a luminous lamp 510 for lighting, a luminous lamp housing 520 in which the luminous lamp is mounted, and a coupling housing 530 having one end inserted into the battery assembly 600.

A shape of the luminous lamp housing 520 is preferably formed so that a lower side thereof has an outer periphery having a larger radius than an upper side thereof.

The luminous lamp housing 520 is configured to be inserted into the turning off switch housing 400 and move together.

Referring to FIG. 5, the luminous lamp 510 is configured to be connected to a positive electrode (+) lead wire 550 and a negative electrode (−) lead wire 540. Each terminal of the positive electrode (+) lead wire 550 and the negative electrode (−) lead wire 540 connected to the luminous lamp 510 is formed in the coupling housing 530.

The battery assembly 600 is also mounted between the upper body housing 200 and the lower body housing 300 and is configured to include an internal battery 610 in contact with the luminous lamp assembly when the luminous lamp assembly 500 is moved.

The battery assembly 600 includes the battery 610 therein, and an inner circumferential surface of the battery assembly 600 is formed of a material capable of conducting electricity.

The battery 610 serves to supply power so that the luminous lamp 510 mounted on the luminous lamp assembly 500 turns on when the luminous lamp assembly 500 moves forward.

Looking at the lighting principle of the luminous lamp, the terminal of the positive electrode (+) lead wire 550 in the coupling housing 530 is maintained in a state in which the terminal is in contact with the inner circumferential surface of the battery assembly 600 capable of conducting electricity.

When the luminous lamp assembly 500 moves forward, the terminal of the negative electrode (−) lead wire 540 is in contact with a positive electrode (+) part 620 of the battery 610 of the battery assembly 600, and thus the luminous lamp 510 is turned on.

In other words, the positive negative electrode (−) lead wire 540 connected to the luminous lamp 510 is connected to the positive (+) part of the battery, and the positive electrode (+) lead wire 550 is in contact with the inner circumferential surface of the battery assembly 600 to serve as a ground, and thus the luminous lamp 510 is turned on.

A push member 410 is formed at one end of the turning off switch housing 400. Also, the luminous lamp assembly 500 is inserted into the turning off switch housing 400, and moves in the same direction as the luminous lamp assembly 500. When luminous lamp assembly 500 moves forward toward the inside of the battery assembly 600, the turning off switch housing 400 moves forward in the same direction along the outer circumferential surface of the battery assembly 600.

On the outer circumferential surface of the turning off switch housing 400, a step 410 with an inclined surface is formed symmetrically on the upper and lower sides.

The push buttons 700 are formed in the upper housing 200 and the lower housing 300, respectively, and an inclined surface 710 is formed in each push button 700.

When the turning off switch housing 400 moves forward, the inclined surface 710 of the push button 700 formed on the upper housing comes into contact with the step 410 on the upper side of the turning off switch housing 400, and the inclined surface 710 of the push button 700 formed on the lower housing comes into contact with the step 410 on the lower side of the turning off switch housing 400.

It is preferable that the inclined surface of the stepped portion 410 and the inclined surface 710 formed on the push button 700 are configured to have the same angle.

Hereinafter, with reference to FIGS. 6 to 9, an operating principle of lighting and turning off the luminous lamp through the lighted nock 100 for an arrow according to the present invention will be described.

Figure 6:
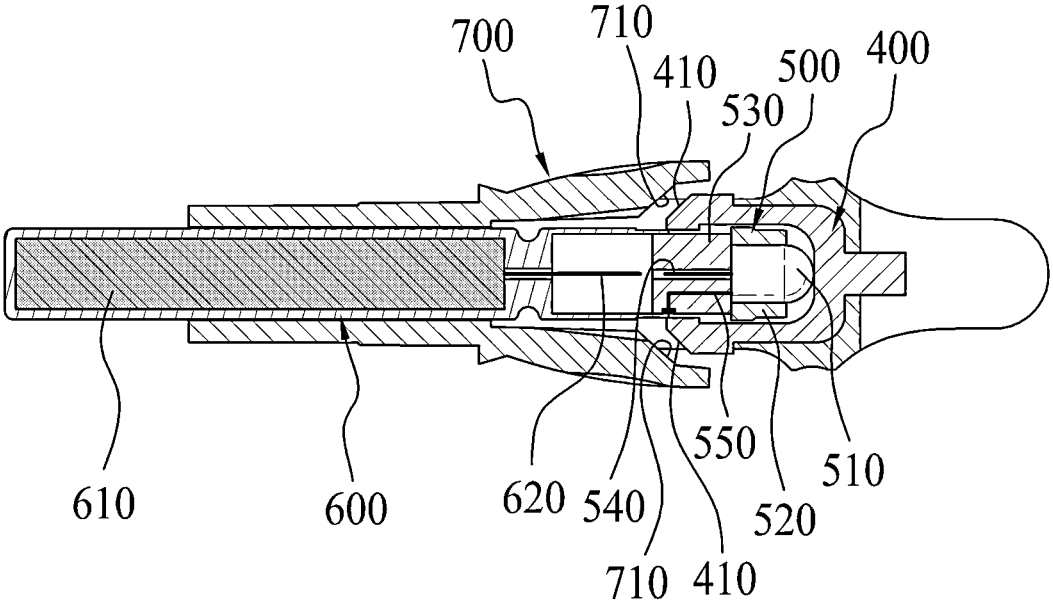
FIG. 6 is an internal configuration diagram of the lighted nock for an arrow according to the present invention.

FIG. 6 is a view illustrating an initial state before shooting a bow equipped with the lighted nock 100 for an arrow.

Figure 7:
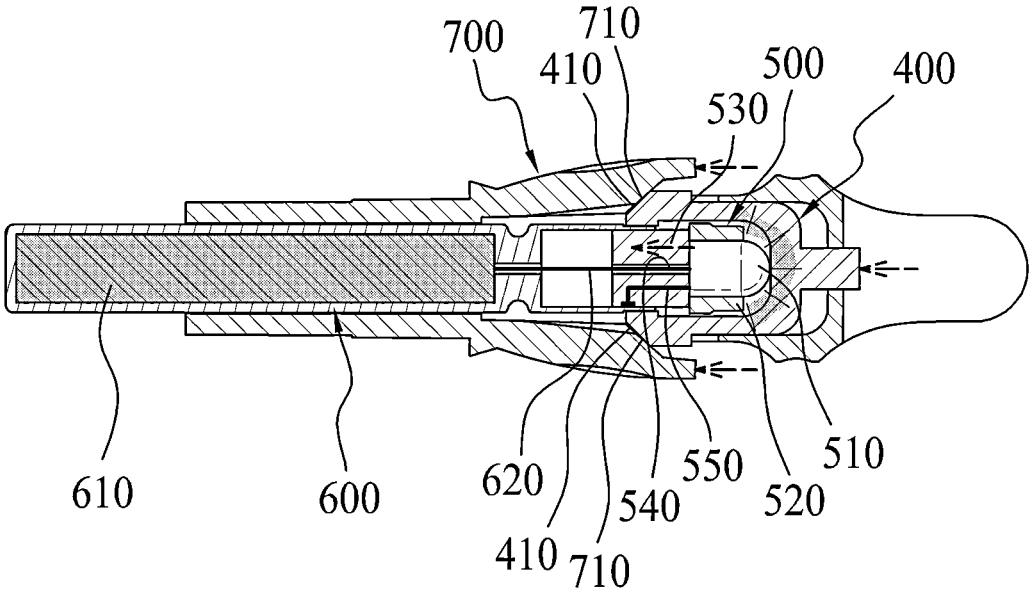
FIG. 7 is a configuration diagram illustrating an internal operation of the lighted nock for an arrow in a lighting process of a luminous lamp according to the present invention.

FIG. 7 is a view explaining a lighting operation of the luminous lamp of the present invention. As shown in the drawing, the push member 410 of the turning off switch housing 400 is moved linearly in a forward direction due to the tension of the string of the bow when the lighted nock 100 for an arrow is mounted and the arrow is shot.

In this case, the luminous lamp assembly 500 inserted into the turning off switch housing 400 is configured to move in the same direction as the turning off switch housing 400 moves forward.

In addition, when the luminous lamp assembly 500 is moved forward, the terminal of the positive electrode (+) lead wire 540 is in contact with the positive electrode (+) part 620 of the battery 610 of the battery assembly 600, and thus the luminous lamp 510 is turned on.

In this case, the luminous lamp assembly 500 moves forward toward the inside of the battery assembly 600, the turning off switch housing 400 moves forward in the same direction along the outer circumferential surface of the battery assembly 600.

When the turning off switch housing 400 is moved, the inclined surface of the stepped portion 410 of the turning off switch housing 400 is configured to be in contact with the inclined surface 710 formed on the push button.

In more detail, when the turning off switch housing 400 moves forward, the inclined surface 710 of the push button 700 formed on the upper housing comes into contact with the step 410 on the upper side of the turning off switch housing 400, and the inclined surface 710 of the push button 700 formed on the lower housing comes into contact with the step 410 on the lower side of the turning off switch housing 400.

Figure 8:
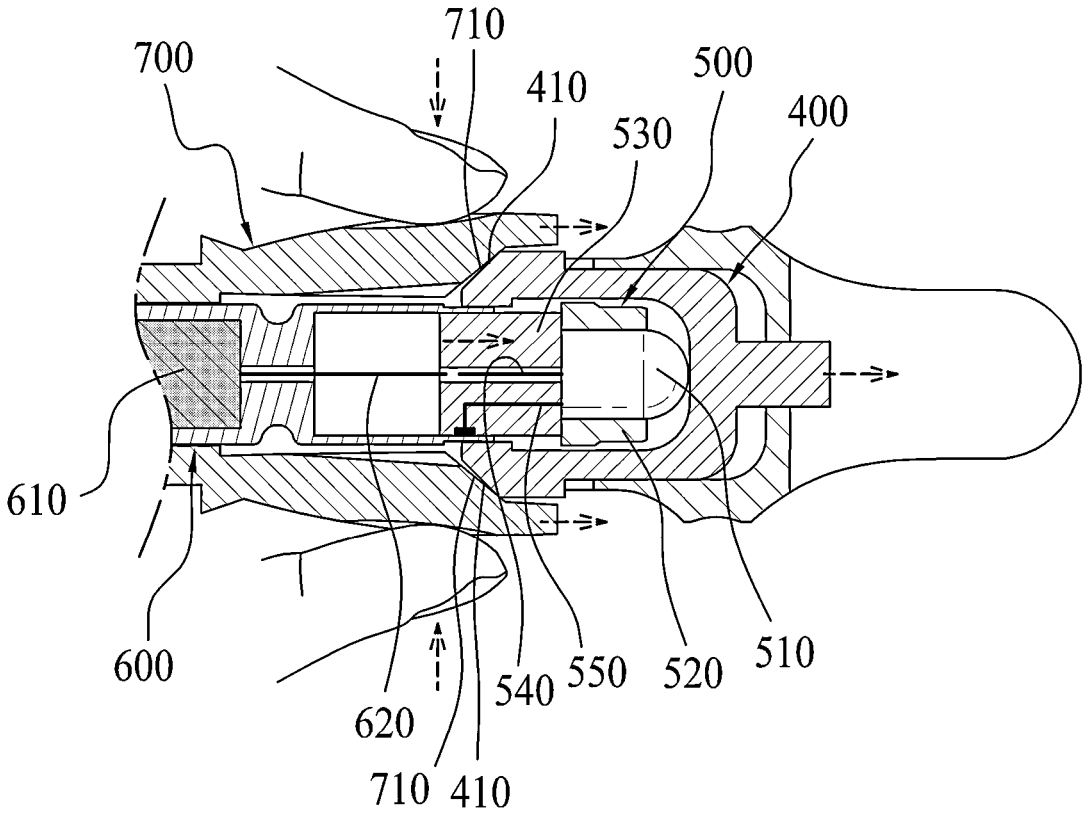
FIG. 8 is a configuration diagram illustrating an internal operation of the lighted nock for an arrow in a process of turning off the luminous lamp according to the present invention.

FIG. 8 is a view explaining a turning off operation of the luminous lamp of the present invention. FIG. 8 is a view explaining an operation process for turning off the luminous lamp 510 turned on in the lighted nock 100 for an arrow again after the arrow is shot.

In the lighted nock for an arrow of the present invention, a turning off method of the luminous lamp 510 is implemented by a one-touch pressing method that is simply turned off by pressing the push button 700 once.

Referring to FIG. 8, the inclined surface of the stepped portion 410 of the turning off switch housing 400 is configured to be in contact with the inclined surface 710 formed on the push button due to the movement of the turning off switch housing 400 in the forward direction in a lighting process of the luminous lamp 510.

When the Push buttons 700 configured in the upper body housing 200 and lower body housing 300 respectively are pressed by hand, a rotational force of the push button 700 acts on the inclined surface of the stepped portion 410 in contact with the inclined surface 710 formed on the push button, and through this, the luminous lamp assembly 500 in contact with the turning off switch housing 400 is linearly moved in a backward direction which is an opposite direction when the luminous lamp is turned on.

When the luminous lamp assembly 500 is moved in the backward direction which is an opposite direction when the luminous lamp is turned on, the negative electrode (–) lead wire 540 of the luminous lamp 510 and the positive electrode (+) part 620 of the battery 610 are returned to a non-contact state again, and the luminous lamp 510 is turned off.

Figure 9:
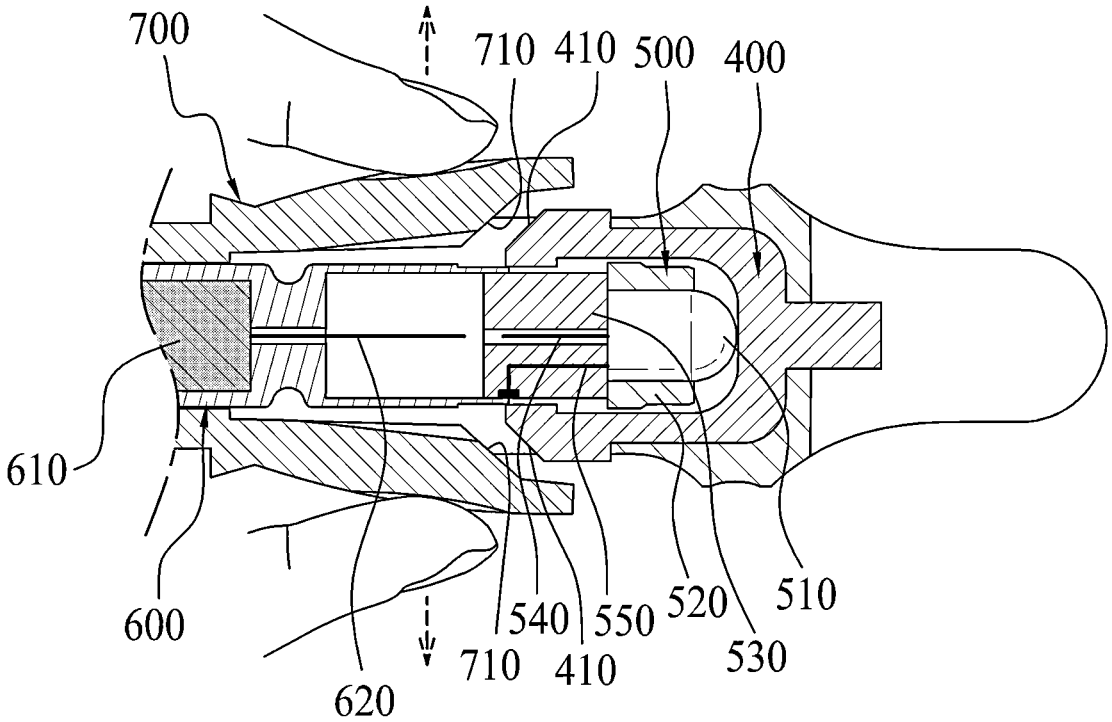
FIG. 9 is an internal configuration diagram of the lighted nock for an arrow in a state in which the luminous lamp is turned off after pressing a push button according to the present invention.

Referring to FIG. 9, it shows a state in which the luminous lamp 510 is turned off after pressing the push button 700 and going through the turning off operation.

The lighted nock 100 for an arrow according to embodiment of the present invention is configured to have push buttons 700 in the upper body housing 200 and lower body housing 300, respectively, so that the push button 700 can be operated on both sides.

The luminous lamp 510 can be turned off with a small amount of force by pressing the push buttons 700 on both sides with the fingers while holding the lighted nock 100 for an arrow with the hand.

Figure 10:
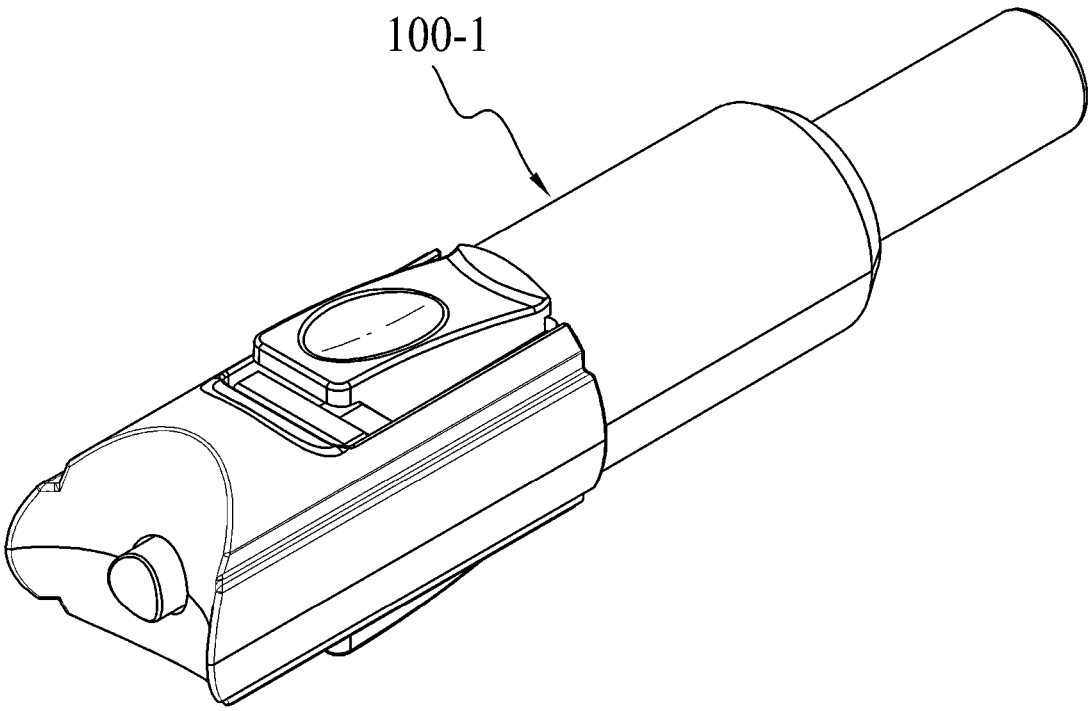
FIG. 10 is a perspective view of a lighted nock for an arrow of the present invention applied to a crossbow

FIG. 10 is a perspective view of lighted nock for an arrow of the present invention applied to a crossbow Referring to FIG. 10, a drawing in which the shape of the lighted nock 100-1 for an arrow of the present invention has been changed so that it can be used appropriately for a crossbow, and the principles of the present invention can be applied as is The above detailed description is illustrative of the present invention. In addition, the foregoing is intended to illustrate and describe preferred embodiments of the present invention, and the present invention may be used in various other combinations, modifications, and environments. That is, changes or modifications are possible within the scope of the concept of the invention disclosed in this specification, within the scope equivalent to the written disclosure and/or within the scope of skill or knowledge in the art. The written embodiment describes the best state for implementing the technical idea of the present invention, and various changes required in the specific application field and use of the present invention are also possible. Therefore, the above detailed description of the invention is not intended to limit the present invention to the disclosed embodiments. Also, the appended claims should be construed to cover other embodiments as well.

What is claimed is:

1. A lighted nock for an arrow, comprising:

an upper body housing;

a lower body housing;

a turning off switch housing mounted between the upper body housing and the lower body housing and moving in a forward direction due to a tension of a string when the arrow is shot;

a luminous lamp assembly mounted between the upper body housing and the lower body housing, inserted into the turning off switch housing, and moved in a same direction as the turning off switch housing when the turning off switch housing is moved;

a battery assembly mounted between the upper body housing and the lower body housing, including an internal battery in contact with the luminous lamp assembly when the luminous lamp assembly is moved, and supplying power so that a luminous lamp mounted on the luminous lamp assembly is turned on; and push buttons configured respectively in the upper body housing and lower body housing, configured to be in contact with the turning off switch housing when the turning off switch housing is moved in the forward direction, and configured to turn off the luminous lamp by moving the luminous lamp assembly in contact with the turning off switch housing in a backward direction and blocking the contact between the luminous lamp assembly and the internal battery of the battery assembly when the push buttons are pressed, wherein stepped portions having an inclined surfaces are formed on the turning off switch housing, an inclined surface is formed on each of the push buttons and are selectively in contact with the inclined surfaces of the stepped portions, wherein angles of the inclined surfaces formed on the turning off switch housing and angles of the inclined surfaces of the push buttons are formed as equal and matching angles, wherein the inclined surfaces of the turn off switch housing are moved in the backward direction relative to the inclined surfaces of the push buttons when the push buttons are depressed by a user.

* * * * *